US006893049B1

(12) United States Patent
Schmitt

(10) Patent No.: US 6,893,049 B1
(45) Date of Patent: May 17, 2005

(54) CRAZY STUD POKER

(76) Inventor: Joseph J. Schmitt, 2071 Maximilian Ave., Spring Hill, FL (US) 34609

( * ) Notice: Subject to any disclaimer, the term of this patent is extended or adjusted under 35 U.S.C. 154(b) by 32 days.

(21) Appl. No.: 10/725,115

(22) Filed: Dec. 2, 2003

(51) Int. Cl.[7] ..... A63F 1/00
(52) U.S. Cl. ..... 283/292; 273/274; 273/309
(58) Field of Search ..... 273/292, 274, 273/309

(56) References Cited

U.S. PATENT DOCUMENTS

| | | | | |
|---|---|---|---|---|
| 5,531,440 | A * | 7/1996 | Dabrowski et al. | 463/12 |
| 5,752,702 | A * | 5/1998 | McDoniel | 273/292 |
| 5,951,012 | A * | 9/1999 | Feola | 273/292 |
| 6,132,311 | A * | 10/2000 | Williams | 463/13 |
| 6,227,969 | B1 * | 5/2001 | Yoseloff | 463/13 |
| 6,299,170 | B1 * | 10/2001 | Yoseloff | 273/292 |
| 6,358,144 | B1 * | 3/2002 | Kadlic et al. | 463/13 |
| 6,416,407 | B1 * | 7/2002 | Carrico et al. | 463/13 |
| 6,425,506 | B1 * | 7/2002 | Wu | 224/219 |
| 6,435,506 | B1 | 8/2002 | Piccoli | |
| 6,443,456 | B1 * | 9/2002 | Gajor | 273/303 |
| 6,454,266 | B1 * | 9/2002 | Breeding et al. | 273/292 |
| 6,575,464 | B1 * | 6/2003 | Fertitta et al. | 273/274 |
| 6,575,467 | B1 * | 6/2003 | Kal | 273/292 |
| 6,604,998 | B1 * | 8/2003 | Singer et al. | 463/13 |
| 2002/0027322 | A1 * | 3/2002 | Breeding et al. | 273/292 |
| 2003/0075869 | A1 * | 4/2003 | Breeding et al. | 273/292 |

* cited by examiner

*Primary Examiner*—Gregory Vidovich
*Assistant Examiner*—Dolores R. Collins

(57) ABSTRACT

A method of playing an improved version of stud poker is disclosed wherein from two to eight players can play the present invention. A fully shuffled 52 card deck of cards is used wherein 14 cards of the deck have wild cards variations printed thereon these selected cards. To start playing the game of the invention each player is dealt one card face down and one card face up. High card passes, bets or calls. The third card is dealt face up and high face up hand passes, bets or calls. A fourth card is now dealt and again the high displayed face up hand either passes, bets or calls. The fifth card is now dealt face up and the sixth card is dealt face down. Final betting is now made by the high cards displayed face up. The face down cards are then turned face up and all hands are evaluated so as to produce the winner. The 14 wild variation cards are what make the method of playing the present crazy stud poker invention an improvement over any other stud poker card game.

5 Claims, 3 Drawing Sheets

CRAZY STUD POKER

BACKGROUND OF THE INVENTION (1) Field of the Invention

The present invention generally relates to methods for playing card games that provide pay-backs to players and, more particularly, pertains to a new and improved method for playing a stud poker game.

(2) Description of the Prior Art

There have been numerous patents granted in the field of methods for playing the game of poker. Each poker game has different rules and also variations thereof which may include the use of designated wild cards such as jokers. Some poker games provide for high and low hand winners.

Prior art methods for playing poker are included in numerous US patents as seen in; U.S. Pat. Nos. 6,604,998; 6,575,467; 6,575,464; 6,443,456; 6,435,506 and 6,416,407.

SUMMARY OF THE INVENTION

In view of the forgoing disadvantages inherent in the known types of poker games now present in the prior art, the present invention provides an improved means of playing stud poker using wild card variations within all four ace suites, all four seven suites, all four two suites and both red and black jokers. The present card game invention has 54 cards therein. Fourteen cards, of these 54 game cards, are used in the present invention to create the wild card variations within the card game of crazy stud poker. The two black ace suites, spades and clubs, are wild cards with the printed words, "ANY BLACK CARD" thereon, while the two red ace suites, diamonds and hearts and are also wild cards with the printed words, "ANY RED CARD" thereon the cards. The wording for all four aces is printed directly on the inside playing surface, at both ends of each card, so all opposing players may see and read the wild card variation. During the game the players that draw any suite ace may use this wild card as any red card in their hand. All four seven suites are also wild cards with the words. "FACE VALUE ANY SUITE", printed directly on the inside playing surface, at both ends of each card, so all opposing players may see and read the wild card variation. All four two suites are also wild cards with the words. "FILLS ANY TWO PAIR", which are also printed directly on the playing surface, at both ends of each card, so all opposing players may see and read the wild card variation. Both jokers are also wild cards. The black joker has the words, "NO VALUE GOOD FOR FREE BET AND RAISE", which are printed directly on the inside playing surface, at both ends, so all opposing players may see and read. The red joker has the words, "GOOD AS ANY CARD", which are printed on the inside of the playing surface, at both ends, so all opposing players may see and read this wild card variation the red or black. As such, the general purpose of the present invention, which will be described subsequently in greater detail, is to provide a new and improved method for playing stud poker which has all the advantages of the prior art and none of the disadvantages.

To attain this, the present invention provides a new and improved method of playing stud poker. All 54 cards are shuffled first, and then the dealer deals two cards to each playing player; one card face down and one card face up. Each player either passes, bets or calls. The third card is dealt face up and the high hand leads off the betting. The fourth card is also dealt up, and the high hand leads off the betting. Both the fifth and sixth cards are now dealt. The fifth card is dealt up and the sixth card is dealt down. Final betting is now made and all the cards are now turned up and evaluated. Up to eight players can play crazy stud poker, with a full 54 card deck of cards, at the same time. Each player receives a total of six cards during any one hand. There are a total of fourteen wild card variations. All other cards in the deck are played at displayed face value. Using these special values, any player may use duplicate cards in a flush. Straights of any kind must reach a five card range. The use of jokers can be optional by the dealer. Another option within the scope of the present invention is a version wherein the players may shorten the game, crazy stud poker, to draw poker if desired by dealing 5 cards with a maximum of a three card draw. In this version all 14 wild cards are still used in the same wild card variations.

There has thus been outlined, rather broadly, the more important features of the invention in order that the detailed description thereof that follows may be better understood, and in order that the present contribution to the art may be better appreciated. There are, of course, additional features of the present invention that will be described hereinafter and which will form the subject matter of the claims appended hereto.

In this respect, before explaining at least one embodiment of the present invention in detail, it is to be understood that the present invention is not limited in its application to the details of construction and the arrangement of the components set forth in the following description or illustrated in the drawings. The invention is capable of other embodiments and of being practiced and carried out in various ways, also, it is to be fully understood that the phraseology and terminology employed herein are for the purpose of description and should not be regarded as limited.

As such, those skilled in the art will appreciate that the conception, upon which this disclosure is based, may readily be utilized as a basis for the designing of other structures, methods and systems for carrying out the several purpose of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the present application. The abstract is neither intended to define the invention of the application, which is measured by the claims, nor is it intended to be limited as to the scope of the present invention in any way.

It is therefore an object of the present invention to provide a new and improved stud poker game which has the advantage of the prior art devises and none of the disadvantages.

It is another object of the present invention to provide a new and improved stud poker game which may be easily and efficiently manufactured and marketed.

It is a further object of the present invention to provide a new and improved stud poker game which is of a durable and reliable construction.

An even further object of the present invention is to provide a new and improved stud poker game which is susceptible of a low cost of manufacture with regard to both materials and labor, and which accordingly is then susceptible of low prices of sale to the consuming public, thereby making such stud poker game economically available to the buying public.

Still yet another object of the present invention is to provide a new and improved stud poker game which provides in the apparatuses and methods of the prior art some of the advantages thereof, while simultaneously overcoming some of the advantages normally associated therewith.

Still another object of the present invention is to provide a new and improved stud poker game operable from a novice's level.

Yet another object of the present invention is to provide a new and improved system stud poker game.

These together with other objects of the present invention, along with the various features of novelty which characterize the present invention, are pointed out with a particularity in the claims annexed to and forming a part of this disclosure. For a better understanding of the present invention, its operating and installation advantages and the specific objects attained by its uses, reference should be had to the accompanying drawings and descriptive matter in which there are illustrated preferred embodiments of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
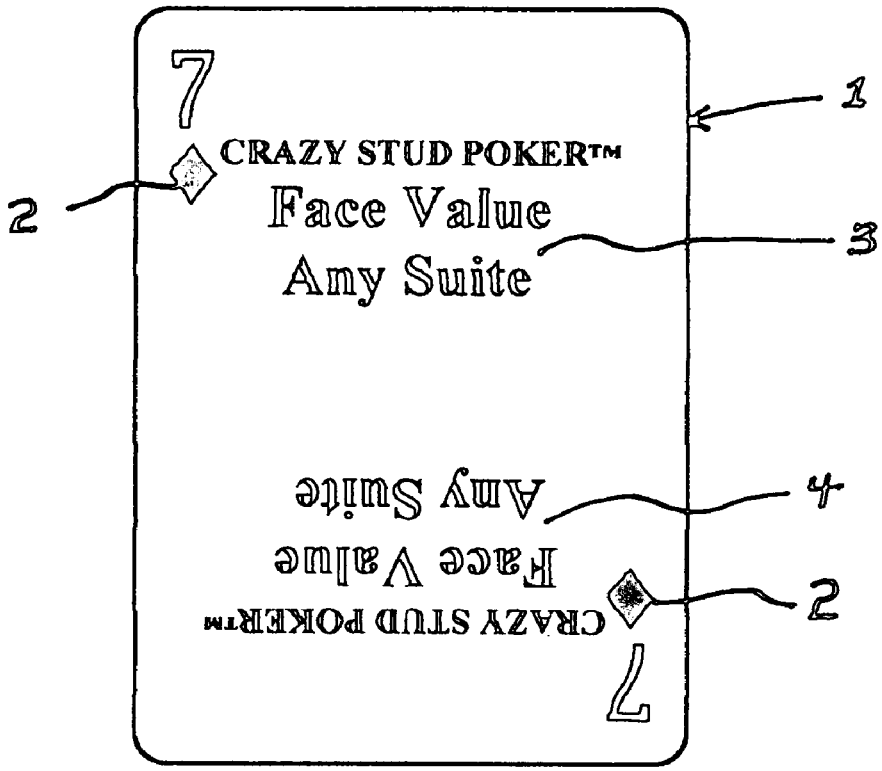
FIG. 1 is an illustrated drawing for one of the number seven playing card with the written wild card variation, "FACE VALUE ANY CARD", printed twice, at opposite ends of the card.
Figure 2:
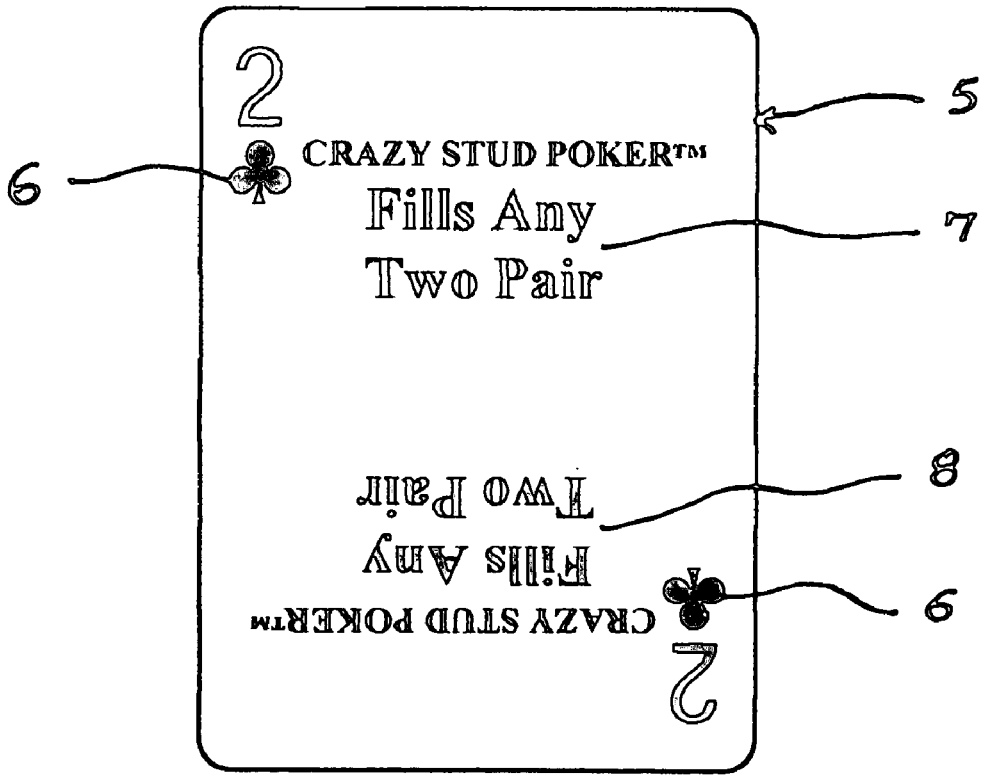
FIG. 2 is an illustrated drawing for one of the number two playing card with the written wild card variation, "FILLS ANY TWO PAIR", printed twice, at opposite ends of the card.
Figure 3:
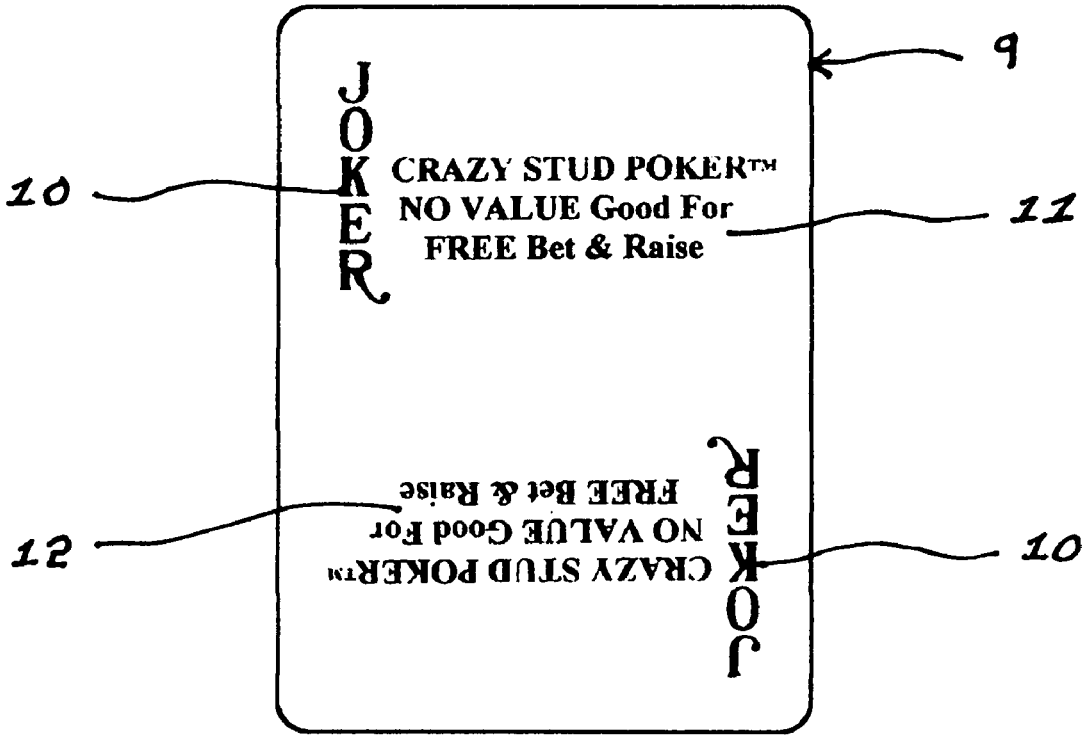
FIG. 3 is an illustrated drawing of the black joker playing card with the written wild card variation, "NO VALUE GOOD FOR FREE BET AND RAISE", printed twice, at opposite ends of the card.
Figure 4:
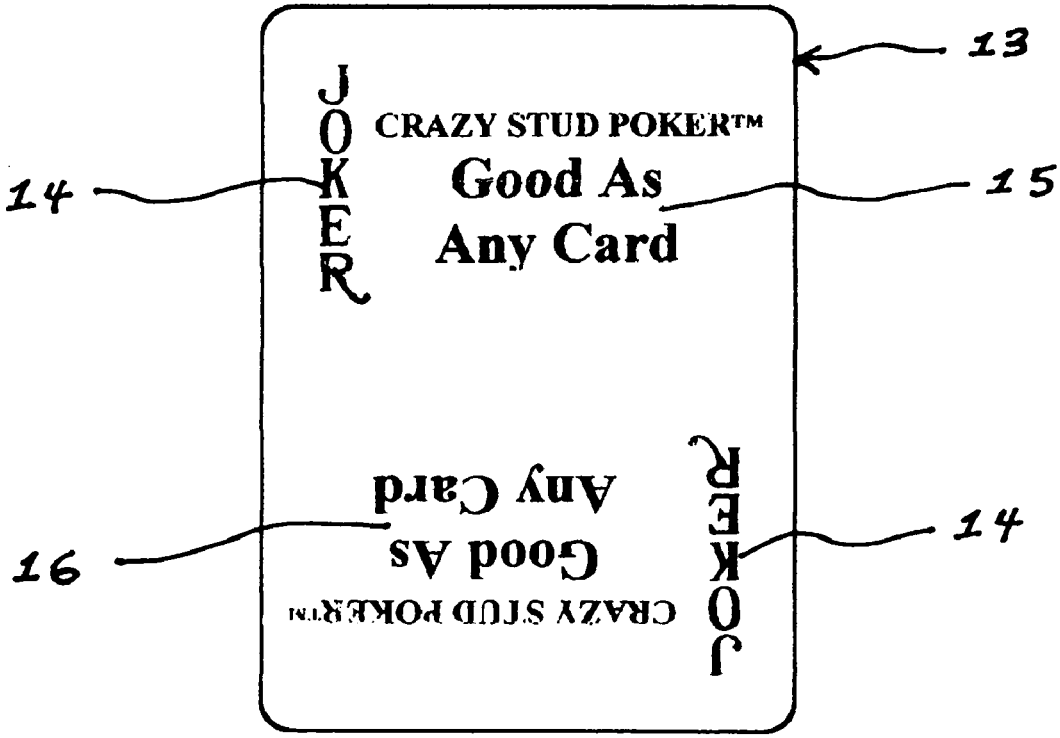
FIG. 4 is an illustrated drawing of the red joker playing card with the written wild card variation. "GOOD AS ANY CARD", printed twice, at opposite ends of the card.
Figure 5:
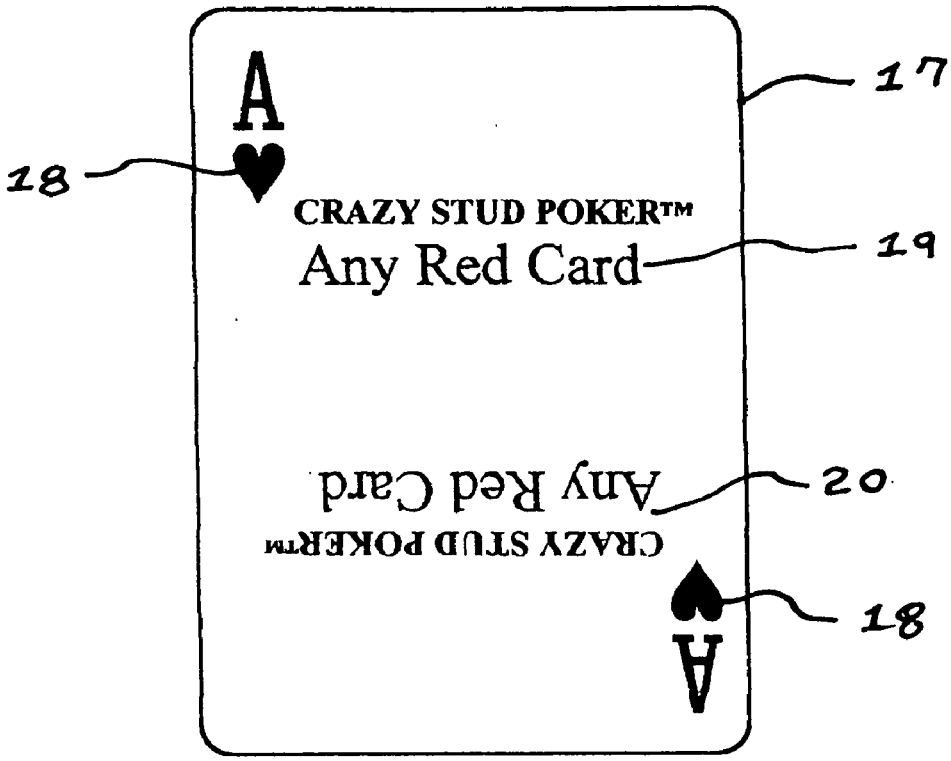
FIG. 5 is an illustrated drawing of the red ace with the written wild card variation, "ANY RED CARD", printed twice, at opposite ends of the card.
Figure 6:
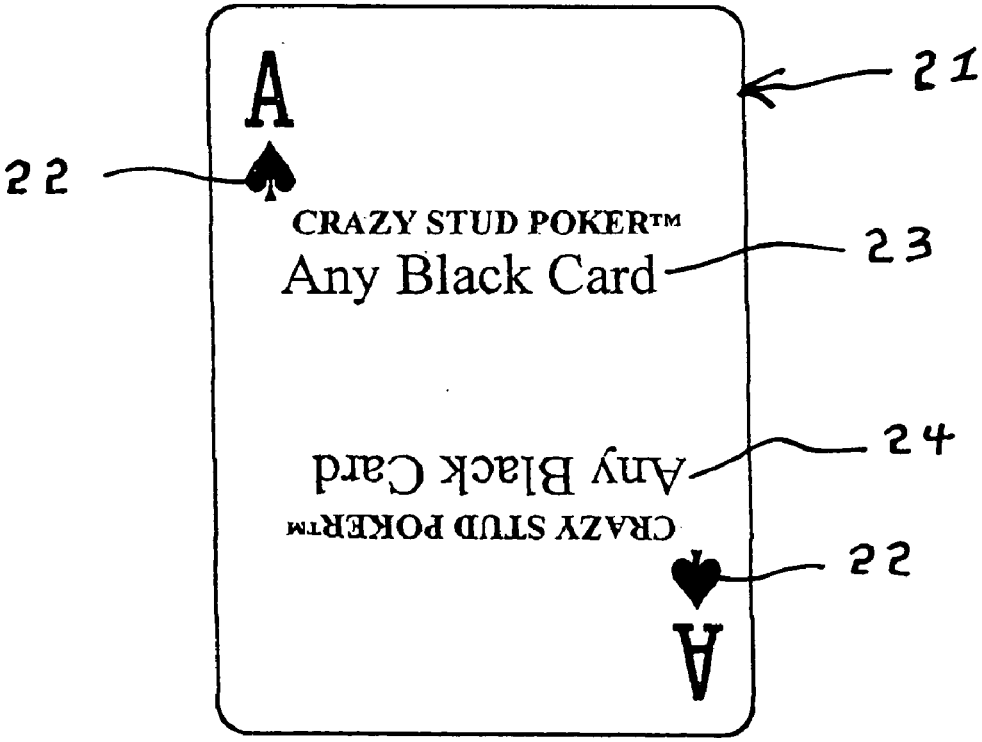
FIG. 6 is an illustrated drawing of the black ace with the written wild card variation, "ANY BLACK CARD", printed twice, at opposite ends of the card.

With reference now to the aforementioned drawings of the present invention, and in particular FIG. 1 thereof, a new and improved method of playing stud poker will now be described wherein illustrated is a playing card 1 as a seven of diamonds 2 with the printed wild card game phrase, "FACE VALUE ANY SUITE", 3 at the top of playing card 1 and the same printed phrase 4 is a also printed at the opposite end of playing card 1. In FIG. 2 the playing card 5 is illustrated as a two of clubs 6 with the printed wild card game phrase, "FILLS ANY TWO PAIR", 7 at the top of playing card 5 and the same printed phrase 8 is also printed at the opposite end of the playing card 5. In FIG. 3 the playing card 9 is illustrated as a black joker 10 with the printed wild card phrase, "NO VALUE GOOD FOR FREE BET AND RAISE", 11 at the top of the playing card 9 and the same phrase 12 is also printed at the opposite end of the playing card 9. In FIG. 4 the playing card 13 is illustrated as a red joker 14 with the printed wild card game phrase, "GOOD AS ANY CARD", 15 at the top of playing card 13 and the same phrase 16 is also printed at the opposite end of playing card 13. In FIG. 5 the playing card 17 is illustrated as an ace of hearts 18 with the printed wild card game phrase, "ANY RED CARD", 19 at the top of playing card 17 and the same phrase 20 is also printed at the opposite end of playing card 17. In FIG. 6 the playing card 21 is illustrated as an ace of spades 22 with the printed wild card phrase, "ANY BLACK CARD", 23 at the top of the playing card 21 and the same phrase 24 is also printed at the opposite end of playing card 21.

In playing the game of the present invention the 54 cards are shuffled thoroughly first, and then the designated dealer deals two cards to each player I the game. The first card is dealt face down and the second card is dealt face up. Each player either passes, bets or calls. The third card is now dealt face up and the player with the high hand leads off the betting. The fourth card is now dealt face up, and the high hand again leads off the betting. Both the fifth and sixth cards are now dealt face up, and the fifth card is dealt face up while the sixth card is dealt face down. Final betting is now made by all players and then all face down cards are now turned up and evaluated. From two to eight players may play the present invention of crazy stud poker at the same time. A full deck of 54 cards are used to play the present invention. Each player is dealt a total of six cards during any one hand of the present invention. Four face up cards and two face down cards. There are a total of 14 wild cards variations. All other cards in the deck are played at displayed face value. With the use of these special value variations displayed o the 14 cards, any player may use duplicate cards in a flush. Any of the produced straights must be reached within the standard five card range. The use of the wild card joker can be made optional by the dealer. Still another option within the scope and method of playing the present stud poker invention is a version wherein the players may consider shortening the present game of the invention, crazy stud poker, to the option of playing draw poker if desired by dealing 5 cards with a maximum of a three card draw. In this version all 14 wild cards of the present invention are still used in the same manner of playing the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will be readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method for playing a stud poker game comprising, in combination;

(A) a deck of 54 playing cards; said deck being 2 jokers and 52 said cards; said cards having 14 cards therein with the wild card phrases printed thereon said cards, said 14 cards and said phrases being;

(1) 2 black aces, spade and club suite playing cards, with said printing being, ANY BLACK CARD, thereon both said black cards, and 2 red aces, diamond and heart suite playing cards, with said printing being, ANY RED CARD, thereon both said red cards;

(2) 4 sevens; club, spade, diamond and heart suite playing cards with said printing being, FACE VALUE IN ANY SUITE, thereon all 4 seven cards;

(3) 4 deuces; club, spade, diamond and heart suite playing cards with said printing being, FILLS ANY TWO PAIR, thereon all 4 said deuce cards;

(4) 1 red joker playing card with said printing being, GOOD AS ANY CARD, thereon said red joker card, and 1 black joker playing card with said printing being, NO VALUE GOOD FOR FREE BET AND RAISE, thereon said black joker card, with option therefore; and (B) said method for playing said game with said playing cards comprising; said 54 cards are first shuffled thoroughly, included therein are said 14 wild cards; a designated dealer deals two cards from said deck to said players in said game; a first card being dealt face down to said players; a second said card being dealt face up to said players; each said player either passes, bets or calls; a third said card being dealt face up to said players; said players with the highest face up hand leads off the betting; a fourth said card being dealt face up to said players; said player with said high face up hand leads off said betting; a fifth said card being dealt face up to said players; a sixth said card being dealt face down to said players; final said betting is now made by said high face up hand player and said players either fold, pass or raise; all said face down cards are turned face up and said players evaluate said cards so as to produce a winner for said stud poker game of the present invention; said game having options and alternative rules therein.

2. A method of playing a stud poker game as claimed in claim 1 wherein said printing on said 14 wild cards is printed on the playing surface of all said 14 wild cards at the top position of said cards and is also printed upside down, or reversed, on the bottom position of said cards so as to been seen and read by all said players in said card game.

3. A method of playing a stud poker game as claimed in claim 1 wherein said options include; using special values such as duplicate cards in a flush; straights of any kind must reach a five card range; the use of said jokers can be optionally selected by the dealer; and wherein said game may be shortened so as to play draw poker if desired by dealing 5 cards with a maximum of a three card draw.

4. A method of playing a stud poker game as claimed in claim 1 wherein the number of players may range from 1 to 8.

5. A method of playing a stud poker game as claimed in claim 4 wherein the number of players is at least 2 players.

* * * * *